US006293134B1

(12) United States Patent
Johnson

(10) Patent No.: US 6,293,134 B1
(45) Date of Patent: Sep. 25, 2001

(54) METHOD OF PRODUCING A SHEET STEEL PRODUCT SUCH AS A MOTOR VEHICLE BUMPER BEAM IN A PROGRESSIVE DIE SYSTEM

(75) Inventor: Martin Johnson, Luleå (SE)

(73) Assignee: SSAB Hardtech AB, Lulea (SE)

( * ) Notice: Subject to any disclaimer, the term of this patent is extended or adjusted under 35 U.S.C. 154(b) by 0 days.

(21) Appl. No.: 09/498,170

(22) Filed: Feb. 4, 2000

Related U.S. Application Data

(63) Continuation-in-part of application No. PCT/SE98/01354, filed on Jul. 9, 1998.

(30) Foreign Application Priority Data

Aug. 7, 1997 (SE) ..... 9702878

(51) Int. Cl.[7] ..... B21D 53/88; B21D 28/32
(52) U.S. Cl. ..... 72/335; 72/342.1; 29/897.2
(58) Field of Search ..... 72/335, 336, 339, 72/330, 329, 334, 342.1, 342.94; 29/897.2

(56) References Cited

U.S. PATENT DOCUMENTS

| | | | | |
|---|---|---|---|---|
| 2,424,643 | * | 7/1947 | Williams | 72/342.94 |
| 3,447,357 | * | 6/1969 | Chow . | |
| 4,111,029 | * | 9/1978 | Dulaquais | 72/342.1 |
| 5,007,275 | * | 4/1991 | Voss | 72/335 |
| 5,182,933 | * | 2/1993 | Schick | 72/335 |
| 5,263,353 | * | 11/1993 | Bakermans | 72/334 |
| 5,676,510 | * | 10/1997 | Fischer | 411/84 |

FOREIGN PATENT DOCUMENTS

| | | | | |
|---|---|---|---|---|
| 1490535 | | 11/1997 | (GB) . | |
| 58-127092 | * | 7/1983 | (JP) | 72/335 |
| 08010868 | | 1/1996 | (JP) . | |
| 634820 | * | 11/1978 | (SU) | 72/335 |
| 761109 | * | 9/1980 | (SU) | 72/338 |

* cited by examiner

*Primary Examiner*—Daniel C. Crane
(74) *Attorney, Agent, or Firm*—Nils H. Ljungman & Associates

(57) ABSTRACT

A sheet steel blank is stamped and held in a pair of tools. The blank has holes that are collared by means of mandrels in connection with the forming. The collaring is carried out in the material. In this way, holes with very narrow tolerances can be achieved. Such holes in a bumper beam can be used for guiding the bumper beam during the mounting thereof on a vehicle.

20 Claims, 4 Drawing Sheets

FIG. 7
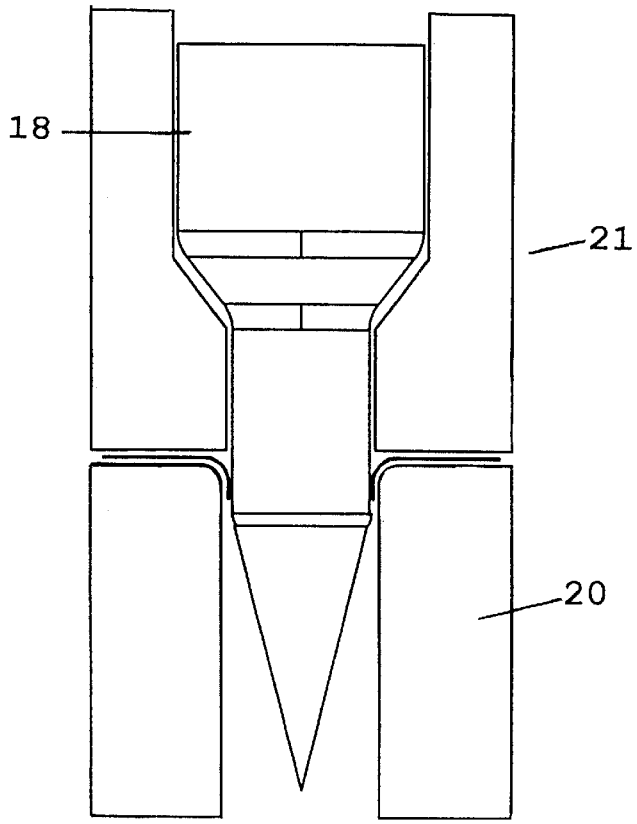
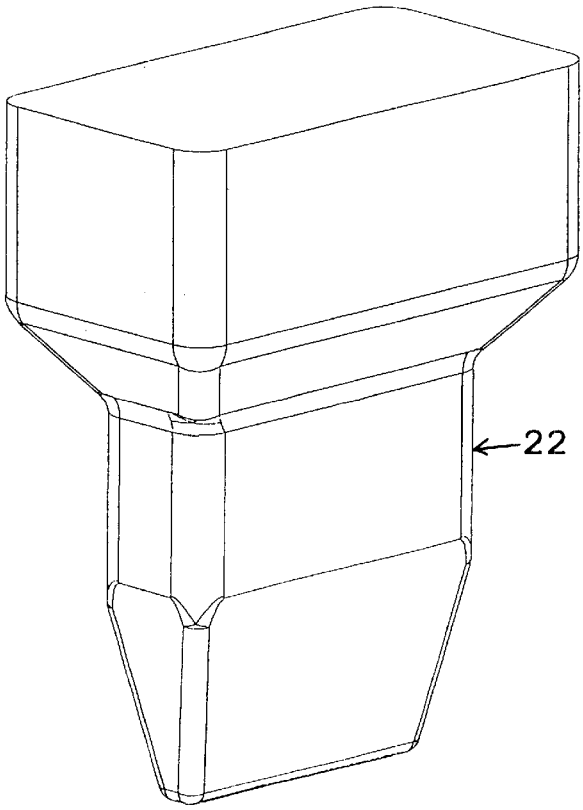
FIG. 8

METHOD OF PRODUCING A SHEET STEEL PRODUCT SUCH AS A MOTOR VEHICLE BUMPER BEAM IN A PROGRESSIVE DIE SYSTEM

CONTINUING APPLICATION DATA

This application is a Continuation-In-Part application of International Application No. PCT/SE98/01354, filed on Jul. 9, 1998, which claims priority from Swedish Patent Application No. 9702878-1, filed on Aug. 7, 1997. International Application No. PCT/SE98/01354 was pending as of the filing date of the present U.S. application, and the U.S. was an elected state in the International Application No. PCT/SE98/01354.

BACKGROUND OF THE INVENTION

1. Field of the Invention

The present invention relates to a method of producing a sheet steel product, for example, a beam, in a press process in which a blank is stamped.

2. Background Information

A method for producing steel products is described in GB 149035-A. An important advantage of the process is that sheet steel products of complicated form can be produced and, despite the complicated form, can have narrow tolerances in form and size.

Conventionally, in order to have a still higher accuracy on certain parts, for example, guiding holes and the like, a machining operation, for example, punching of holes, is carried out on the finished product. This machining operation causes high wear on the tools and might cause a reduction in the fatigue strength.

OBJECT OF THE INVENTION

It may be an object of the present invention to provide, in an essentially simple and cost-effective way, holes that have an essentially high accuracy in size and in position in the finished product. According to the invention, these holes may be finished by the collaring of pre-made holes directly in a press.

SUMMARY OF THE INVENTION

One feature of the present invention resides broadly in a method of producing a motor vehicle bumper beam from sheet steel using a progressive die system, said method comprising the steps of forming a sheet metal blank from sheet steel to form a bumper beam; punching, with a plurality of punches, a plurality of holes in the sheet metal blank, of a predetermined size and configuration, for a plurality of collared holes to be formed in the sheet metal blank; moving the sheet metal blank to at least one stamping machine having a pair of dies configured to stamp the sheet metal blank and form a motor vehicle bumper beam; placing the sheet metal blank between the pair of dies configured to hold the sheet metal blank and configured to collar holes in the sheet metal blank; stamping the sheet metal blank; collaring the plurality of holes in the sheet metal blank and forming the motor vehicle bumper beam; and holding the formed motor vehicle bumper beam for a predetermined period of time between the pair of dies configured to form the motor vehicle bumper beam.

The above-discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention will be described in more detail with reference to the accompanying drawings which, as an example only, show a bumper beam produced in accordance with the invention.

FIG. 7 shows a mandrel while collaring the pre-made hole shown in FIG. 5 into the hole shown in FIG. 3; and FIG. 8 shows a mandrel for collaring the hole shown in FIG. 6 into the hole shown in FIG. 4.

DESCRIPTION OF THE PREFERRED EMBODIMENT

Figure 1:
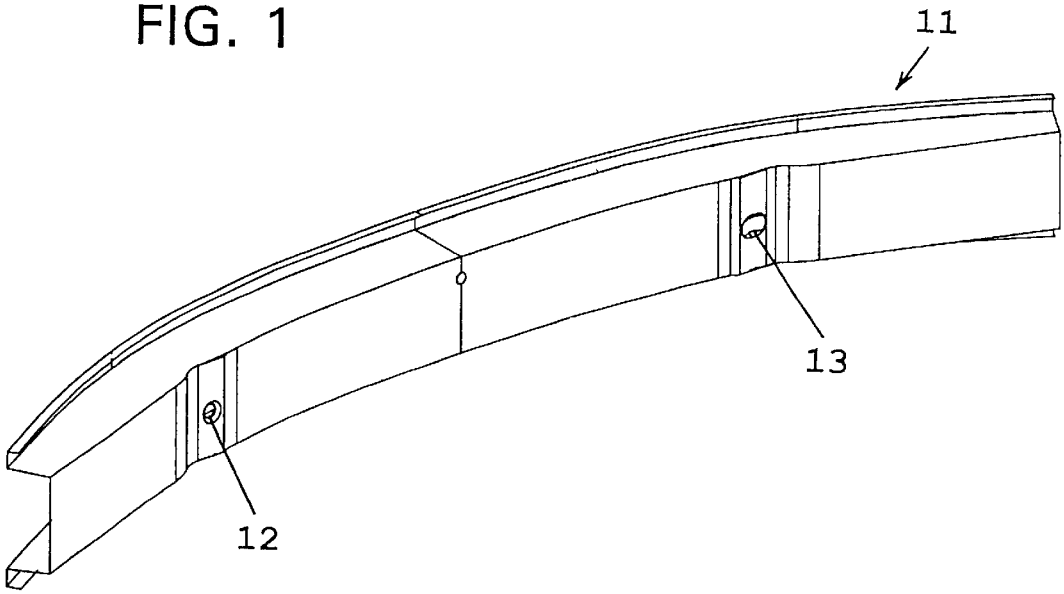
FIG. 1 shows the bumper beam in a perspective view.
Figure 2:
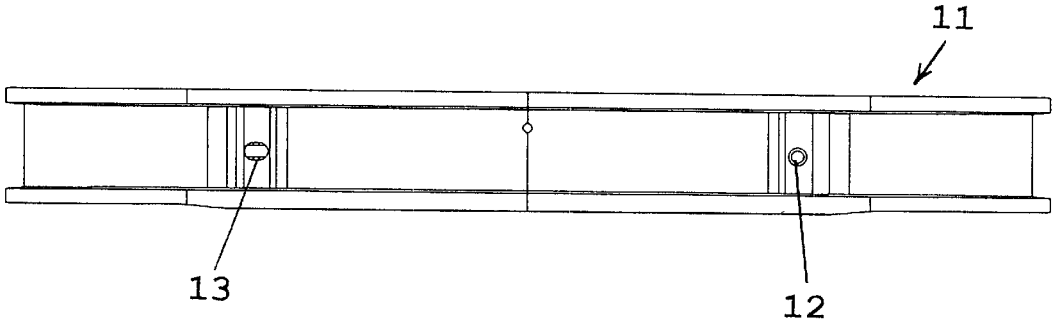
FIG. 2 shows the bumper beam in a front plan view.

The bumper beam or sheet metal product 11 shown in FIGS. 1 and 2 may be made of sheet steel, for example, a boron steel. In principle, the bumper beam or sheet metal product 11 shown in FIG. 11 consists of a bow-formed U-profile, or a so-called hat profile, with side flanges. The beam 11 can be provided with a front cover welded to the side flanges. A hard foam can be fixed to the cover.

In other words, the present invention is not limited to the production of bumper beams or other beams but can also be used for the production of other sheet steel products.

For making the bumper beam 11, one may start with an essentially flat sheet steel blank with a desired number of slots and holes. The tolerances in position and size of the holes and slots achieved in the finished beam may usually be sufficient. For some holes, an improved accuracy may be necessary. In FIG. 1, which is a perspective view seen from behind, two guiding holes 12, 13 are shown as examples of such holes. They may be used to guide the bumper beam when the beam is being mounted on a vehicle such as a passenger car.

Figure 3:
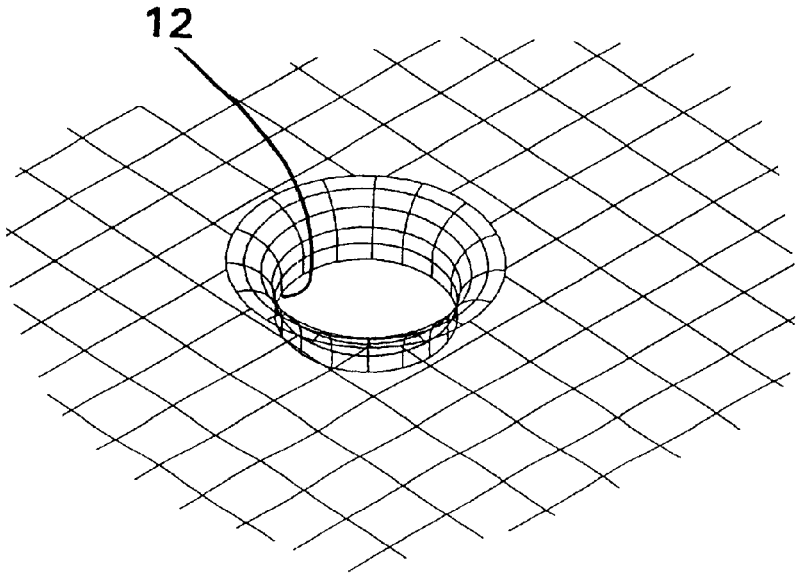
FIGS. 3 and 4 show enlarged two guiding holes in the bumper beam.
Figure 4:
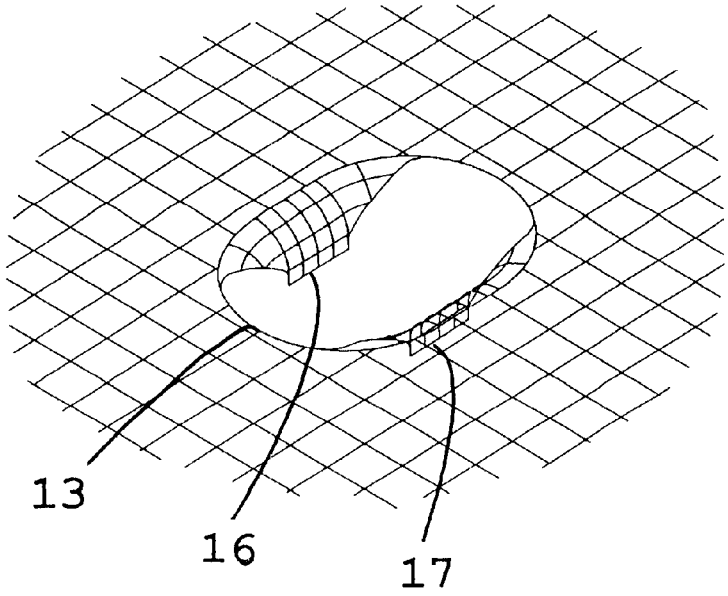
Figure 5:
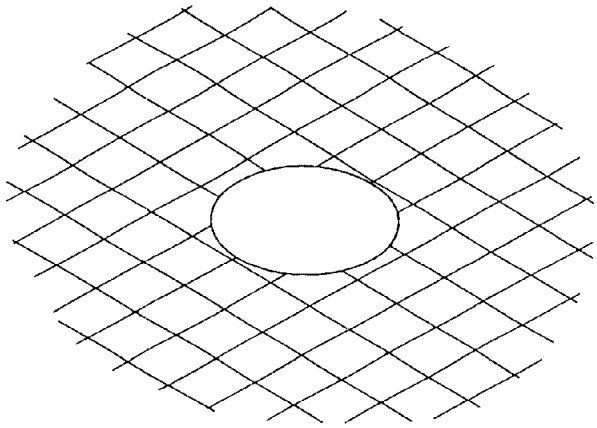
FIGS. 5 and 6 show the guiding holes of FIGS. 3 and 4 as they looked in the flat blank before the stamping of the blank into the beam.

FIG. 2, which is a front plan view of the bumper beam, shows these guiding holes 12, 13 as well. FIG. 3 shows the guiding hole 12 enlarged and FIG. 4 shows the guiding hole 13 enlarged.

Figure 6:
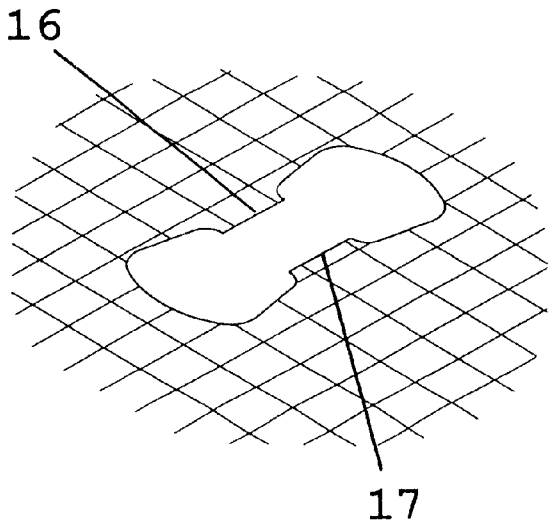

The holes 12, 13 may be collared to their final shape in connection with the stamping of the blank into the finished beam 11. The hole 12 may be collared from an essentially circular hole with a diameter that can be approximately 40 to approximately 60 percent, for example, of the final diameter. In the blank, the hole 13 has the dog-bone-like shape shown in FIG. 6. The length of the hole 13 essentially will not change by the collaring; the central flaps 16, 17 may only be bent.

In other words, the hole 13 before and after collaring may have a length essentially greater than its width. The collaring process of the hole 13 may consist in bending the flaps 16, 17, which may be parallel sides, generally away from the center of the hole 13.

FIG. 7 shows a round mandrel 18 used for collaring the circular hole 12 and also the pair of tools 20, 21 for stamping the blank into the beam 11. The mandrel 18 in FIG. 7 guided in the upper tool 21. FIG. 8 shows a corresponding rectangular mandrel 22 used to collar the central part of the hole 13 as described.

In other words, in at least one possible embodiment of the present invention, at least one of a round mandrel 18 or a rectangular mandrel 22 may be used to collar at least one of the holes 12, 13.

One possible process of making the finished beam 11 from the blank will now be described. The blank may be moved into position on the lower tool 20, and the upper tool 21 may stamp the blank, which may thus be formed between the tools or dies 20, 21. Thus the tools 20, 21 may act as fixtures for the blank or beam 11. The mandrel 18 and the mandrel 22 may move downward and make collars on the holes 12, 13 in the blank or beam 11 while it is being held in the dies 20, 21 or during the stamping of the blank or beam 11.

The device for moving the mandrels 18, 22 up and down is not shown because it is conventional. The mandrels 18, 22 can alternatively be guided by the lower tool 20 instead of by the upper tool 21. As an alternative to movable mandrels 18, 22, the mandrels 18, 22 can be fixed to the upper movable tool 21.

Horizontally, the mandrel 22 may be shorter than the length of the original hole 13 in the blank, which may allow the beam to shrink somewhat. Since the longish hole 13 may be directed along a radius from the hole 12, the forces from the shrinking will essentially not be hazardous to the mandrels 18, 22.

By making one guiding hole 12 essentially circular, it may have essentially narrow tolerance in all directions. By having the longish hole 13 directed along a radius from the circular hole 12 as shown, the longish hole 13 may have essentially narrow tolerance only transverse to the beam. By using the two guiding holes 12, 13 when mounting the bumper beam 11 on the vehicle, the tolerances of the mounting may be essentially tight.

The invention is not limited to the production of bumper beams or other beams but can be used also for the production of other sheet steel products. In other words, in at least one possible embodiment of the present invention, the two guiding holes 12, 13 may be used to guide a sheet steel product other than a motor vehicle bumper beam.

In other words, in one possible embodiment of the present invention, the steel blank may have a thickness within the range of approximately 0.030 inches to approximately 0.070 inches.

In another possible embodiment of the present invention, the steel blank may have a thickness within the range of approximately 0.020 inches to approximately 0.120 inches.

The present invention may relate to a method of producing a hardened sheet steel product, for example, a beam, in a press hardening process in which a blank is hot stamped and the stamped product is hardened while remaining in the pair of stamping tools.

A method for producing hardened steel products is described in GB 149035-A and referred to as press hardening. An important advantage of the process is that hardened sheet steel products of complicated form can be produced and, despite the complicated form, can have narrow tolerances in form and size.

Conventionally, in order to have a still higher accuracy on certain parts, for example, guiding holes and the like, a machining operation, for example, punching of holes, is carried out on the finished product. This machining operation causes high wear on the tools and might cause a reduction in the fatigue strength.

It may be an object of the invention to provide, in an essentially simple and cost-effective way, holes that have an essentially high accuracy in size and in position in the finished product. According to the present invention, these holes may be finished by the collaring of pre-made holes directly in the press hardening operation and before the hardening.

Another possible process of making the finished beam 11 from the blank will now be described. At first, the blank may be usually heated in a furnace to a temperature at which it is fully or partly austenitic, that is, usually to a temperature approximately above Ac3. Then, the hot blank may be moved into position on the lower tool 20, and the upper tool 21 may stamp the blank, which may thus be formed between the tools or dies 20, 21. The tools 20, 21 may be essentially cold and may be cooled essentially continuously so that the beam 11 may be essentially rapidly cooled from the temperature approximately above Ac3. The beam or sheet metal blank or product 11 essentially hardens while being clamped between the tools 20, 21. Thus the tools 20, 21 may act as a fixture during the hardening. The mandrel 18 and the mandrel 22 may move downward and make collars on the holes 12, 13 in the hot blank or hot beam 11 or during the stamping. The mandrels 18, 22 will cool the collars so that they too will harden. The collars may harden more or less but may be essentially formed before they harden. Typically, a product of boron steel may have a yield strength of 1300 Mpa, and the collars may have somewhat lower strength. The weldability may be essentially very good despite the essentially high strength.

Horizontally, the mandrel 22 may be shorter than the length of the original hole 13 in the blank, which may allow the beam to shrink somewhat during its cooling. Since the longish hole 13 may be directed along a radius from the hole 12, the forces from the shrinking will essentially not be hazardous to the mandrels 18, 22.

In other words, the bumper beam or sheet metal product 11 shown in FIGS. 1 and 2 is made of hardenable sheet steel, for example, a boron steel. It may be possible that several different compositions of steel may be suitable for use in at least one possible embodiment of the present invention. One example of a steel that may be used in at least one possible embodiment of the present invention may have the following composition: approximately 0.05 percent to approximately 0.15 percent carbon; approximately less than 1.0 percent silicon; approximately 2.0 percent or less manganese; approximately 0.04 percent or less phosphorus; approximately 0.01 percent or less sulfur; approximately 20 to approximately 30 percent chromium; approximately 10 to approximately 15 percent nickel; approximately 0.10 to 0.30 percent nitrogen; approximately 0.0010 percent to 0.01 percent boron; at least one of lanthanum or cesium for a total amount, of at least one of lanthanum or cesium, of approximately 0.01 percent to 0.10 percent; approximately 0.01 percent to 0.20 percent aluminum; and a balance of iron and incidental or unavoidable impurities. Some possible advantages of this first example of a possible steel may include suitability for working at essentially high temperatures and essentially good weldability.

A second example of a steel that may be used in at least one possible embodiment of the present invention may have the following composition: approximately 0.5 or less weight percent silicon; approximately 1.0 or less weight percent manganese; approximately 13 weight percent to approximately 18 weight percent chromium; approximately 30 weight percent to approximately 50 weight percent of molybdenum and tungsten combined; approximately 0.1 weight percent to approximately 0.8 weight percent niobium and vanadium combined; approximately 0.01 weight percent to approximately 0.2 weight percent nitrogen; and the balance or residual consisting of iron and unavoidable or incidental impurities.

A third example of a steel that may be used in at least one possible embodiment of the present invention may have the following composition: approximately 0.15 percent to approximately 0.30 percent carbon; approximately 1.0 percent to approximately 1.50 percent manganese; and approximately 0.010 percent to approximately 0.030 percent columbium. This third example of a possible steel may provide essentially low hardenability and high strength, which may both be essentially suitable characteristics of steel intended for use in the manufacture of bumper beams and other sheet steel products.

A fourth example of a steel that may be used in at least one possible embodiment of the present invention may have the following composition: approximately 0.05 percent to approximately 0.15 percent carbon; approximately 0.5 percent or less silicon; approximately 0.05 percent to approximately 0.50 percent manganese; approximately 17 percent to approximately 25 percent chromium; approximately 7 percent to approximately 20 percent nickel; approximately 2.0 percent to approximately 4.5 percent copper; approximately 0.10 percent to approximately 0.80 percent niobium; approximately 0.001 percent to approximately 0.010 percent boron; approximately 0.05 percent to approximately 0.25 percent nitrogen; approximately 0.003 percent to approximately 0.030 percent sol.aluminum; approximately 0 percent to approximately 0.015 percent magnesium; and the balance being iron and incidental or unavoidable impurities. This fourth example of a steel may also include approximately 0.3 percent to approximately 2.0 percent molybdenum, approximately 0.5 percent to approximately 4.0 percent tungsten, or a combination of both approximately 0.3 percent to approximately 2.0 percent molybdenum and approximately 0.5 percent to approximately 4.0 percent tungsten. One possible advantage of this fourth example of a steel may be essentially high strength at essentially high temperatures.

A fifth example of a steel that may be used in at least one possible embodiment of the present invention has the following composition: approximately less than 0.07 weight percent carbon; approximately less than 1.0 weight percent silicon; approximately less than 2.0 weight percent manganese; approximately 16 weight percent to approximately 18 weight percent chromium; approximately 6.0 weight percent to approximately 8.0 weight percent nickel; approximately less than 0.005 weight percent aluminum; approximately less than 0.05 weight percent phosphorus; approximately less than 0.005 weight percent sulfur; approximately less than 0.03 weight percent titanium; approximately less than 0.003 weight percent boron; approximately less than 3.0 weight percent copper; approximately less than 0.3 weight percent molybdenum; approximately less than 0.1 weight percent niobium; approximately less than 0.45 weight percent nitrogen; and the balance being iron and other indispensable, unavoidable, or incidental impurities. Some possible advantages of this fifth example of a steel may include an essentially lower cost than a steel containing relatively higher weight percents of nickel, essentially superior press-formability, and essentially high durability at essentially high temperatures.

In one possible embodiment of the present invention, the sheet steel blank, the sheet steel product, or the sheet steel blank and the sheet steel product may be heated to a temperature within the range of approximately 1500 degrees Fahrenheit to approximately 2000 degrees Fahrenheit, at a rate of approximately 1000 degrees Fahrenheit per second, for approximately two seconds.

In another possible embodiment of the present invention, the sheet steel blank, the sheet steel product, or the sheet steel blank and the sheet steel product may be heated to a temperature within the range of approximately 780 degrees Celsius to approximately 840 degrees Celsius.

In yet another possible embodiment of the present invention, the sheet steel blank, the sheet steel product, or the sheet steel blank and the sheet steel product may be heated to a temperature of approximately 950 degrees Celsius for a time period within the range of approximately 10 seconds to approximately 10 minutes.

In still another possible embodiment of the present invention, the sheet steel blank, the sheet steel product, or the sheet steel blank and the sheet steel product may be heated to a temperature within the range of approximately 850 degrees Celsius to approximately 1050 degrees Celsius for a period of approximately 2 seconds or longer.

In a further possible embodiment of the present invention, the sheet steel blank, the sheet steel product, or the sheet steel blank and the sheet steel product may be heated to a temperature within the range of approximately 1100 degrees Celsius to approximately 1250 degrees Celsius.

In other words, the steel used to form the sheet steel blank, or the steel used to form the sheet steel product, in one possible embodiment of the present invention, may have a yield strength within the range of approximately 50,000 pounds of force per square inch to approximately 60,000 pounds of force per square inch.

In another possible embodiment of the present invention, the steel used to form the sheet steel product, or the steel used to form the sheet steel blank, may have a yield strength within the range of approximately 40,000 pounds of force per square inch to approximately 80,000 pounds of force per square inch, or substantially greater, which yield strength may essentially prevent the sheet steel product from buckling or cracking.

In yet another possible embodiment of the present invention, the cooling or decrease in temperature of the sheet metal product, the sheet metal blank, or the sheet metal product and the sheet metal blank may occur at a rate of approximately 1000 degrees Fahrenheit per second.

In other words, in at least one possible embodiment of the present invention, the cooling or decrease in temperature of the sheet metal product, the sheet metal blank, or the sheet metal product and the sheet metal blank may occur at a rate that will cause the sheet metal product, the sheet metal blank, or the sheet metal product to become martensitic or to develop a hard martensitic microstructure. For example, the cooling or decrease in temperature of the sheet metal product, the sheet metal blank, or the sheet metal product and the sheet metal blank may occur at a rate of approximately 1000 degrees Fahrenheit per second.

In still another possible embodiment of the present invention, the cooling or decrease in temperature of the sheet metal product, the sheet metal blank, or the sheet metal product and the sheet metal blank may occur according to at least one of the following: a cooling rate of approximately less than 100 degrees Celsius per second; a cooling rate within the range of approximately 5 degrees Celsius per minute to approximately 100 degrees Celsius per minute; cooling such that the temperature is either maintained, for at least approximately 30 seconds, within the range of approximately 550 degrees Celsius to approximately 350 degrees Celsius or slowly decreased at a rate of approximately 400 degrees Celsius or less per minute within the range of approximately 550 degrees Celsius to approximately 350 degrees Celsius.

In a further possible embodiment of the present invention, the cooling or decrease in temperature of the sheet metal product, the sheet metal blank, or the sheet metal product and the sheet metal blank may occur within the range of approximately 30 degrees or more per second.

In one possible embodiment of the present invention, holes, for example, circular holes, dog-bone-like holes, or circular holes and dog-bone-like holes may be formed in a sheet steel blank before the blank is stamped into a beam or other sheet metal product.

In another possible embodiment of the present invention, holes, for example, circular holes, dog-bone-like holes, or circular holes and dog-bone-like holes, may be formed in a sheet steel blank in the same machine or die system that stamps the blank into a beam and collars holes in the beam or sheet metal product.

In yet another possible embodiment of the present invention, at least a part of the sheet metal product or sheet metal blank may be heated.

In still another possible embodiment of the present invention, at least a part of the sheet metal product or sheet metal blank may be hardened.

One feature of the invention resides broadly in a method of producing a sheet metal product from sheet steel using a die system, said method comprising the steps of: forming a sheet metal blank from sheet steel to form a sheet metal product; forming at least one hole in the sheet metal blank, of a predetermined size and configuration, for at least one collared hole to be formed in the sheet metal blank; moving the sheet metal blank to at least one stamping machine having a pair of dies configured to stamp the sheet metal blank and form the sheet metal product; stopping the sheet metal blank between the pair of dies configured to hold the sheet metal blank and configured to collar holes in the sheet metal blank; stamping the sheet metal blank; collaring the at least one hole in the sheet metal blank; forming the sheet metal product; and holding the formed sheet metal product between the pair of dies configured to form the sheet metal product to harden the sheet metal product.

Another feature of the invention resides broadly in a method of producing a sheet metal product from sheet steel using a die system, said method comprising the steps of: forming a sheet metal blank from sheet steel to form a sheet metal product; forming at least one hole in the sheet metal blank, of a predetermined size and configuration, for at least one collared hole to be formed in the sheet metal blank; heating the sheet metal blank; moving the sheet metal blank to at least one stamping machine having a pair of dies configured to stamp the sheet metal blank and form the sheet metal product; stopping the sheet metal blank between the pair of dies configured to hold the sheet metal blank and configured to collar holes in the sheet metal blank; stamping the heated sheet metal blank; collaring the at least one hole in the heated sheet metal blank to produce the sheet metal product; forming the sheet metal product; and holding the formed sheet metal product for a predetermined period of time between the pair of dies configured to form the sheet metal product to harden the sheet metal product.

Yet another feature of the invention resides broadly in the method of producing a hardened sheet steel product in a press hardening process in which a blank is hot stamped and the stamped product 11 is hardened while remaining in the pair of stamping tools, characterized in that holes 12, 13 are collared in the product 11 when the product is in the tools 20, 21.

Still another feature of the invention resides broadly in the method characterized in that the holes 12, 13 are collared by means of mandrels 18, 23 that are fixed with the movable one 21 of the pair of tools.

A further feature of the invention resides broadly in the method characterized in that the holes are collared by means of mandrels 18, 22 that are axially movable in one of the tools of the pair of tools 20, 21.

Another feature of the invention resides broadly in the method according to any one of the preceding tools, characterized in that at least one longish hole 13 is collared to have parallel collared sides in order to have narrow tolerance in one direction only.

Yet another feature of the invention resides broadly in the method characterized in that a dog-bone-like hole 13 is made in the blank and the central part of the hole is bent to a collar.

Still another feature of the invention resides broadly in the method characterized in that a circular hole 12 and a longish hole 13 are collared into a circular guiding hole 19 and a longish guiding hole 13, and the longish guiding hole is directed substantially along a radius from the circular guiding hole.

A further feature of the invention resides broadly in a method in which a sheet steel blank (11) is hot stamped and rapidly cooled in a pair of cooled tools (20, 21) in a process usually called press hardening. The blank has holes (12, 13) that are collared by means of mandrels in connection with the forming. The collaring is carried out in unhardened material, but the collars harden directly when formed. In this way, holes with very narrow tolerances can be achieved. Such holes in a bumper beam can be used for guiding the bumper beam during the mounting thereof on a vehicle.

Some examples of steel and steel products that may be used in at least one possible embodiment of the present invention may be found in the following U.S. Pat. No. 5,841,046, issued to inventors Rhodes et al. on Nov. 24, 1998; U.S. Pat. No. 5,839,549, issued to inventor Tack, Jr. on Nov. 24, 1998; U.S. Pat. No. 5,824,264, issued to inventors Uno et al. on Oct. 20, 1998; U.S. Pat. No. 5,753,177, issued to inventors Morinaga et al. on May 19, 1998; U.S. Pat. No. 5,749,981, issued to inventors Tonteling et al. on May 12, 1998; U.S. Pat. No. 5,672,216, issued to inventor Robic on Sep. 30, 1997; U.S. Pat. No. 5,669,992, issued to inventors Bronsema et al. on Sep. 23, 1997; U.S. Pat. No. 5,626,817, issued to inventors Sawaragi et al. on May 6, 1997; U.S. Pat. No. 5,571,343, issued to inventors Ryoo et al. on Nov. 5, 1996; U.S. Pat. No. 5,565,044, issued to inventors Kim et al. on Oct. 15, 1996; U.S. Pat. No. 5,556,483, issued to inventors Tahara et al. on Sep. 17, 1996; U.S. Pat. No. 5,554,233, issued to inventors Heitmann et al. on Sep. 10, 1996; U.S. Pat. No. 5,543,109, issued to inventors Senba et al. on Aug.

6, 1996; U.S. Pat. No. 5,509,977, issued to inventors Yano et al. on Apr. 23, 1996; U.S. Pat. No. 5,470,529, issued to inventors Nomura et al. on Nov. 28, 1995; U.S. Pat. No. 5,362,439, issued to inventors Bletton et al. on Nov. 8, 1994; U.S. Pat. No. 5,328,529, issued to inventors Cordea et al. on Jul. 12, 1994; U.S. Pat. No. 5,293,766, issued to inventor Chang on Mar. 15, 1994; U.S. Pat. No. 5,277,048, issued to inventor Lubas on Jan. 11, 1994; U.S. Pat. No. 5,228,177, issued to inventors Herzog et al. on Jul. 20, 1993; U.S. Pat. No. 4,849,169, issued to inventors Maziasz et al. on Jul. 18, 1989; U.S. Pat. No. 4,830,686, issued to inventors Hashiguchi et al. on May 16, 1989; U.S. Pat. No. 4,822,556, issued to inventors Cordea et al. on Apr. 18, 1989; U.S. Pat. No. 4,584,035, issued to inventors Arai et al. on Apr. 22, 1986; U.S. Pat. No. 4,568,387, issued to inventor Ziemianski on Feb. 4, 1986; U.S. Pat. No. 4,528,046, issued to inventors Yamamoto et al. on Jul. 9, 1985; U.S. Pat. No. 4,502,886, issued to inventors Cordea et al. on Mar. 5, 1985; U.S. Pat. No. 4,444,588, issued to inventor Ney, Sr. on Apr. 24, 1984; U.S. Pat. No. 4,394,169, issued to inventors Kaneko et al. on Jul. 19, 1983; and U.S. Pat. No. 4,139,240, issued to inventors Profio et al. on Feb. 13, 1979.

Some examples of bumper beams that may be used in at least one possible embodiment of the present invention may be found in the following U.S. Pat. No. 5,672,216, issued to inventor Robic on Sep. 30, 1997; U.S. Pat. No. 5,669,992, issued to inventors Bronsema et al. on Sep. 23, 1997; U.S. Pat. No. 5,566,874, issued to inventor Sturrus on Oct. 22, 1996; and U.S. Pat. No. 4,830,686, issued to inventors Hashiguchi et al. on May 16, 1989.

Some examples of dies, die systems, punching means, stamping machines, collaring machines, and mandrels that may be used in at least one possible embodiment of the present invention may be found in the following U.S. Pat. No. 5,687,604, issued to inventor Robbins on Nov. 18, 1997; U.S. Pat. No. 5,672,216, issued to inventor Robic on Sep. 30, 1997; U.S. Pat. No. 5,613,416, issued to inventor Fujita on Mar. 25, 1997; U.S. Pat. No. 5,600,992, issued to inventors Kanazawa et al. on Feb. 11, 1997; U.S. Pat. No. 5,566,874, issued to inventor Sturrus on Oct. 22, 1996; U.S. Pat. No. 5,526,852, issued to inventor Rakovski on Jun. 18, 1996; U.S. Pat. No. 5,228,177, issued to inventors Herzog et al. on Jul. 20, 1993; U.S. Pat. No. 5,164,205, issued to inventor Aimono on Nov. 17, 1992; U.S. Pat. No. 5,016,461, issued to inventors Walker et al. on May 21, 1991; U.S. Pat. No. 5,009,095, issued to inventor Voss on Apr. 23, 1991; U.S. Pat. No. 5,007,275, issued to inventor Voss on Apr. 16, 1991; U.S. Pat. No. 5,000,068, issued to inventor Knabel on Mar. 19, 1991; U.S. Pat. No. 4,852,382, issued to inventors Gietz et al. on Aug. 1, 1989; U.S. Pat. No. 4,836,009, issued to inventor Schulte on Jun. 6, 1989; U.S. Pat. No. 4,827,758, issued to inventor Schulte on May 9, 1989; U.S. Pat. No. 4,586,248, issued to inventor Ho on May 6, 1986; U.S. Pat. No. 4,568,387, issued to inventor Ziemianski on Feb. 4, 1986; U.S. Pat. No. 4,545,272, issued to inventor Herb on Oct. 8, 1985; U.S. Pat. No. 4,471,643, issued to inventors Champoux et al. on Sep. 18, 1984; U.S. Pat. No. 4,406,199, issued to inventor Rom on Sep. 27, 1983; U.S. Pat. No. 4,356,719, issued to inventors Sutherland et al. on Nov. 2, 1982; U.S. Pat. No. 4,307,599, issued to inventor Wrona on Dec. 29, 1981; U.S. Pat. No. 4,296,301, issued to inventor Johnson on Oct. 20, 1981; U.S. Pat. No. 4,275,652, issued to inventor Bo on Jun. 30, 1981; U.S. Pat. No. 4,226,109, issued to inventor Nilsson on Oct. 7, 1980; U.S. Pat. No. 4,168,644, issued to inventors Leibinger et al. on Sep. 25, 1979; U.S. Pat. No. 4,159,676, issued to inventors Joyce et al. on Jul. 3, 1979; U.S. Pat. No. 4,147,492, issued to inventors Thiel et al. on Apr. 3, 1979; U.S. Pat. No. 4,132,097, issued to inventor Ames on Jan. 2, 1979; U.S. Pat. No. 4,129,028, issued to inventors Leftheris et al. on Dec. 12, 1978; U.S. Pat. No. 4,129,022, issued to inventors Thonnes et al. on Dec. 12, 1978; U.S. Pat. No. 4,103,637, issued to inventor Luc on Aug. 1, 1978; U.S. Pat. No. 4,103,414, issued to inventors Herb et al. on Aug. 1, 1978; and U.S. Pat. No. 3,973,426, issued to inventors Fujita et al. on Aug. 10, 1976.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Swedish Patent Application No. 9702878-1, filed on Aug. 7, 1997, having inventor Martin Jonsson, and International Application No. PCT/SE98/01354, filed on Jul. 9, 1998, having an International Publication Date of Feb. 18, 1999, and having International Publication Number WO 99/07492, as well as their published equivalents, and other equivalents or corresponding applications, if any, in corresponding cases in Sweden and elsewhere, and the references cited in any of the documents cited herein, are hereby incorporated by reference as if set forth in their entirety herein.

The details in the patents, patent applications and publications may be considered to be incorporable, at Applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A method of producing a motor vehicle bumper beam from sheet steel using a progressive die system, said method comprising the steps of:

forming a sheet metal blank from sheet steel to form a bumper beam;

punching, with a plurality of punches, a plurality of holes in the sheet metal blank, of a predetermined size and configuration, for a plurality of collared holes to be formed in the sheet metal blank;

moving the sheet metal blank to at least one stamping machine having a pair of dies configured to stamp the sheet metal blank and form a motor vehicle bumper beam;

placing the sheet metal blank between the pair of dies configured to hold the sheet metal blank and configured to collar holes in the sheet metal blank;

stamping the sheet metal blank;

collaring the plurality of holes in the sheet metal blank and forming the motor vehicle bumper beam; and holding the formed motor vehicle bumper beam for a predetermined period of time between the pair of dies configured to form the motor vehicle bumper beam.

2. The method according to claim 1, wherein:

said pair of dies configured to hold the sheet metal blank comprises a movable die and a stationary die;

said stationary die comprises at least one mandrel;

said at least one mandrel is configured to be disposed to collar said plurality of holes in the sheet metal blank; and said step of collaring is accomplished using said at least one mandrel.

3. The method according to claim 1, wherein:

said pair of dies configured to hold the sheet metal blank comprises a movable die and a stationary die;

said stationary die comprises at least one mandrel;

said at least one mandrel is configured to be disposed to collar said plurality of holes in the sheet metal blank;

said at least one mandrel has a longitudinal axis;

said at least one mandrel is configured to be disposed to move along said longitudinal axis in one of said pair of dies configured to hold the sheet metal blank; and said step of collaring is accomplished using said at least one mandrel.

4. The method according to claim 2, wherein:

said plurality of holes comprises at least one non-circular hole, said at least non-circular hole comprising a length and a width;

said length of said at least one non-circular hole is substantially greater than said width of said at least one non-circular hole;

said step of collaring comprises collaring said at least one non-circular hole to form parallel collared sides;

said parallel collared sides comprise a first parallel collared side and a second parallel collared side; and said collaring said at least one non-circular hole comprises collaring to minimize tolerance deviations from said first parallel collared side to said second parallel collared side.

5. The method according to claim 3, wherein:

said plurality of holes comprises at least one non-circular hole, said at least one non-circular hole comprising a length and a width;

said length of said at least one non-circular hole is substantially greater than said width of said at least one non-circular hole;

said step of collaring comprises collaring said at least one non-circular hole to form parallel collared sides;

said parallel collared sides comprise a first parallel collared side and a second parallel collared side; and said collaring said at least one non-circular hole comprises collaring to minimize tolerance deviations from said first parallel collared side to said second parallel collared side.

6. The method according to claim 4, wherein said parallel collared sides are collared by bending said parallel collared sides generally away from the center of said at least one non-circular hole.

7. The method according to claim 5, wherein said parallel collared sides are collared by bending said parallel collared sides generally away from the center of said at least one non-circular hole.

8. The method according to claim 6, wherein:

said plurality of holes further comprises at least one substantially circular hole;

said step of collaring further comprises:

collaring said at least one non-circular hole to form at least one first guiding hole, said at least one first guiding hole being configured to guide the motor vehicle bumper beam onto a motor vehicle; and collaring said at least one substantially circular hole to form at least one second guiding hole, said at least one second guiding hole being configured to guide the motor vehicle bumper beam onto a motor vehicle;

said at least one first guiding hole comprises a length and a width;

said length of said at least one first guiding hole is substantially greater than said width of said at least one first guiding hole;

said at least one second guiding hole has a radius; and said length of said at least one first guiding hole is disposed to lie on said radius of said at least one second guiding hole.

9. The method according to claim 7, wherein:

said plurality of holes further comprises at least one substantially circular hole;

said step of collaring further comprises:

collaring said at least one non-circular hole to form at least one first guiding hole, said at least one first guiding hole being configured to guide the motor vehicle bumper beam onto a motor vehicle; and collaring said at least one substantially circular hole to form at least one second guiding hole, said at least one second guiding hole being configured to guide the motor vehicle bumper beam onto a motor vehicle;

said at least one first guiding hole comprises a length and a width;

said length of said at least one first guiding hole is substantially greater than said width of said at least one first guiding hole;

said at least one second guiding hole has a radius; and said length of said at least one first guiding hole is disposed to lie on said radius of said at least one second guiding hole.

10. A method of producing a bumper beam for a motor vehicle from sheet steel using a die system, said method comprising the steps of:

forming a sheet metal blank from sheet steel;

forming at least one hole in the sheet metal blank, of a predetermined size and configuration, for at least one collared hole to be formed in the sheet metal blank;

moving the sheet metal blank to at least one stamping machine having a pair of dies configured to stamp the sheet metal blank;

stopping the sheet metal blank between the pair of dies configured to hold the sheet metal blank and configured to collar holes in the sheet metal blank;

stamping the sheet metal blank, thus forming the bumper beam;

collaring the at least one hole in the sheet metal blank; and holding the formed bumper beam between the pair of dies to cool and harden the bumper beam.

11. The method according to claim 10, wherein:

said pair of dies configured to hold the sheet metal blank comprises a movable die and a stationary die;

one of said movable die and said stationary die comprises at least one mandrel;

said at least one mandrel is configured to be disposed to collar said at least one hole in the sheet metal blank; and said step of collaring is accomplished using said at least one mandrel.

12. The method according to claim 10, wherein:

said pair of dies configured to hold the sheet metal blank comprises a movable die and a stationary die;

one of said movable die and said stationary die comprises at least one mandrel;

said at least one mandrel is configured to be disposed to collar said at least one hole in the sheet metal blank;

said at least one mandrel has a longitudinal axis;

said at least one mandrel is configured to be disposed to move along said longitudinal axis in one of said pair of dies configured to hold the sheet metal blank; and said step of collaring is accomplished using said at least one mandrel.

13. The method according to claim 11, wherein:

said at least one hole comprises at least one non-circular hole, said at least one non-circular hole comprising a length and a width;

said length of said at least one non-circular hole is substantially greater than said width of said at least one non-circular hole is substantially greater than said width;

said step of collaring comprises collaring said at least one non-circular hole to form parallel collared sides;

said parallel collared sides comprise a first parallel collared side and a second parallel collared side;

said collaring said at least one non-circular hole comprises collaring to minimize tolerance deviations from said first parallel collared side to said second parallel collared side;

said parallel collared sides are collared by bending said parallel collared sides generally away from the center of said at least one non-circular hole;

said at least one hole further comprises at least one substantially circular hole;

said step of collaring further comprises:

collaring said at least one non-circular hole to form at least one first guiding hole, said at least one first guiding hole being configured to be disposed to guide the sheet metal product onto a solid structure; and collaring said at least one substantially circular hole to form at least one second guiding hole, said at least one second guiding hole being configured to be disposed to guide the sheet metal product onto a solid structure;

said at least one first guiding hole comprises a length and a width;

said length of said at least one first guiding hole is substantially greater than said width of said at least one first guiding hole;

said at least one second guiding hole has a radius; and said length of said at least one first guiding hole is disposed to lie on said radius of said at least one second guiding hole.

14. The method according to claim 12, wherein:

said at least one hole comprises at least one non-circular hole, said at least one non-circular hole comprising a length and a width;

said length of said at least one non-circular hole is substantially greater than said width of said at least one non-circular hole;

said step of collaring comprises collaring said at least one non-circular hole to form parallel collared sides;

said parallel collared sides comprise a first parallel collared side and a second parallel collared side;

said collaring said at least one non-circular hole comprises collaring to minimize tolerance deviations from said first parallel collared side to said second parallel collared side;

said parallel collared sides are collared by bending said parallel collared sides generally away from the center of said at least one non-circular hole;

said at least one hole further comprises at least one substantially circular hole;

said step of collaring further comprises:

collaring said at least one non-circular hole to form at least one first guiding hole, said at least one first guiding hole being configured to be disposed to guide the sheet metal product onto a solid structure; and collaring said at least one substantially circular hole to form at least one second guiding hole, said at least one second guiding hole being configured to be disposed to guide the sheet metal product onto a solid structure;

said at least one first guiding hole comprises a length and a width;

said length of said at least one first guiding hole is substantially greater than said width of said at least one first guiding hole;

said at least one second guiding hole has a radius; and said length of said at least one first guiding hole is disposed to lie on said radius of said at least one second guiding hole.

15. A method of producing a sheet metal product from sheet steel using a die system, said method comprising the steps of:

forming a sheet metal blank from sheet steel to form a sheet metal product;

forming at least one hole in the sheet metal blank, of a predetermined size and configuration, for at least one collared hole to be formed in the sheet metal blank;

heating the sheet metal blank;

moving the sheet metal blank to at least one stamping machine having a pair of dies configured to stamp the sheet metal blank and form the sheet metal product;

stopping the sheet metal blank between the pair of dies configured to hold the sheet metal blank and configured to collar holes in the sheet metal blank;

stamping the heated sheet metal blank;

collaring the at least one hole in the heated sheet metal blank to produce the sheet metal product;

forming the sheet metal product; and holding the formed sheet metal product for a predetermined period of time between the pair of dies configured to form the sheet metal product to harden the sheet metal product.

16. The method according to claim 15, wherein:

said pair of dies configured to hold the sheet metal blank comprises a movable die and a stationary die;

said stationary die comprises at least one mandrel;

said at least one mandrel is configured to be disposed to collar said at least one hole in the heated sheet metal blank; and said step of collaring is accomplished using said at least one mandrel.

17. The method according to claim 15, wherein:

said pair of dies configured to hold the sheet metal blank comprises a movable die and a stationary die;

said stationary die comprises at least one mandrel;

said at least one mandrel is configured to be disposed to collar said at least one hole in the heated sheet metal blank;

said at least one mandrel has a longitudinal axis;

said at least one mandrel is configured to be disposed to move along said longitudinal axis in one of said pair of dies configured to hold the sheet metal blank; and said step of collaring is accomplished using said at least one mandrel.

18. The method according to claim 16, wherein:

said at least one hole comprises at least one non-circular hole, said at least one non-circular hole comprising a length and a width;

said length of said at least one non-circular hole is substantially greater than said width of said at least one non-circular hole is substantially greater than said width;

said step of collaring comprises collaring said at least one non-circular hole to form parallel collared sides;

said parallel collared sides comprise a first parallel collared side and a second parallel collared side;

said collaring said at least one non-circular hole comprises collaring to minimize tolerance deviations from said first parallel collared side to said second parallel collared side;

said parallel collared sides are collared by bending said parallel collared sides generally away from the center of said at least one non-circular hole;

said at least one hole further comprises at least one substantially circular hole;

said step of collaring further comprises:

collaring said at least one non-circular hole to form at least one first guiding hole, said at least one first guiding hole being configured to be disposed to guide the sheet metal product onto a solid structure; and collaring said at least one substantially circular hole to form at least one second guiding hole, said at least one second guiding hole being configured to be disposed to guide the sheet metal product onto a solid structure;

said at least one first guiding hole comprises a length and a width;

said length of said at least one first guiding hole is substantially greater than said width of said at least one first guiding hole;

said at least one second guiding hole has a radius; and said length of said at least one first guiding hole is disposed to lie on said radius of said at least one second guiding hole.

19. The method according to claim 17, wherein:

said at least one hole comprises at least one non-circular hole, said at least one non-circular hole comprising a length and a width;

said length of said at least one non-circular hole is substantially greater than said width of said at least one noncircular hole;

said step of collaring comprises collaring said at least one non-circular hole to form parallel collared sides;

said parallel collared sides comprise a first parallel collared side and a second parallel collared side;

said collaring said at least one non-circular hole comprises collaring to minimize tolerance deviations from said first parallel collared side to said second parallel collared side;

said parallel collared sides are collared by bending said parallel collared sides generally away from the center of said at least one non-circular hole;

said at least one hole further comprises at least one substantially circular hole;

said step of collaring further comprises:

collaring said at least one non-circular hole to form at least one first guiding hole, said at least one first guiding hole being configured to be disposed to guide the sheet metal product onto a solid structure; and collaring said at least one substantially circular hole to form at least one second guiding hole, said at least one second guiding hole being configured to be disposed to guide the sheet metal product onto a solid structure;

said at least one first guiding hole comprises a length and a width;

said length of said at least one first guiding hole is substantially greater than said width of said at least one first guiding hole;

said at least one second guiding hole has a radius; and said length of said at least one first guiding hole is disposed to lie on said radius of said at least one second guiding hole;

said parallel collared sides comprise a first parallel collared side and a second parallel collared side;

said collaring said at least one non-circular hole to have parallel collared sides is accomplished such as to minimize tolerance deviations from said first parallel collared side to said second parallel collared side;

said parallel collared sides are collared by bending said parallel collared sides generally toward the center of said at least one non-circular hole;

said at least one hole comprises at least one substantially circular hole;

said step of collaring further comprises:

collaring said at least one non-circular hole into at least one first guiding hole, said at least one first guiding hole being configured to be disposed to guide the sheet metal product onto a solid structure; and collaring said at least one substantially circular hole into at least one second guiding hole, said at least one second guiding hole being configured to be disposed to guide the sheet metal product onto a solid structure;

said at least one first guiding hole comprises a length;

said at least one second guiding hole comprises a radius; and said length of said at least one first guiding hole is disposed to lie on said radius of said at least one second guiding hole.

20. A method of producing a motor vehicle bumper beam from sheet steel using a progressive die system, said method comprising the steps of:

forming a sheet metal blank from sheet steel;

punching, with a plurality of punches, a plurality of holes in the sheet metal blank, of a predetermined size and configuration, for a plurality of collared holes to be formed in the sheet metal blank;

heating the sheet metal blank;

moving the sheet metal blank to at least one stamping machine having a pair of dies configured to stamp the sheet metal blank to form a motor vehicle bumper beam;

placing the sheet metal blank between the pair of dies configured to hold the sheet metal blank and configured to collar holes in the sheet metal blank;

stamping the sheet metal blank;

collaring the plurality of holes in the sheet metal blank and forming the motor vehicle bumper beam; and holding the formed motor vehicle bumper beam for a predetermined period of time between the pair of dies to cool and harden the formed motor vehicle bumper beam.

* * * * *

UNITED STATES PATENT AND TRADEMARK OFFICE

CERTIFICATE OF CORRECTION

PATENT NO. : 6,293,134 B1
DATED : September 25, 2001
INVENTOR(S) : Martin Jonsson It is certified that error appears in the above-identified patent and that said Letters Patent is hereby corrected as shown below:

Title page,
Item [75], delete "Johnson," and substitute -- Jonsson, --.

Column 8,
Delete lines 49 through 67, through Column 9, lines 1 through 22.

Signed and Sealed this

Eighth Day of October, 2002

*Attest:*

*Attesting Officer*

JAMES E. ROGAN
*Director of the United States Patent and Trademark Office*